US010844536B2

(12) United States Patent
Louison

(10) Patent No.: US 10,844,536 B2
(45) Date of Patent: Nov. 24, 2020

(54) STEAM IRON SOLE PLATE

(71) Applicant: Bernard Louison, Lyons (FR)

(72) Inventor: Bernard Louison, Lyons (FR)

( * ) Notice: Subject to any disclaimer, the term of this patent is extended or adjusted under 35 U.S.C. 154(b) by 24 days.

(21) Appl. No.: 16/090,233

(22) PCT Filed: Apr. 6, 2017

(86) PCT No.: PCT/FR2017/050836
§ 371 (c)(1),
(2) Date: Sep. 29, 2018

(87) PCT Pub. No.: WO2017/174947
PCT Pub. Date: Oct. 12, 2017

(65) Prior Publication Data

US 2019/0112754 A1 Apr. 18, 2019

(30) Foreign Application Priority Data

Apr. 8, 2016 (FR) ..... 16 53145

(51) Int. Cl.
*D06F 75/20* (2006.01)
*D06F 75/38* (2006.01)

(52) U.S. Cl.
CPC ..... *D06F 75/20* (2013.01); *D06F 75/38* (2013.01)

(58) Field of Classification Search
CPC ..... D06F 75/00–38
See application file for complete search history.

(56) References Cited

U.S. PATENT DOCUMENTS 29,863 A * 9/1860 Chichester ..... D06F 75/20 38/77.83
1,674,092 A * 6/1928 Brewer ..... D06F 75/12 38/77.6
2,042,953 A * 6/1936 McArdle ..... D06F 75/38 29/445
2,365,332 A * 12/1944 Cissell ..... D06F 75/10 38/77.6
2,489,673 A * 11/1949 Richterkessing ..... D06F 75/32 69/20

(Continued)

FOREIGN PATENT DOCUMENTS

DE 29611410 U1 10/1996
WO 2006051099 A1 5/2006

OTHER PUBLICATIONS

Written Opinion of the International Searching Authority for International Application No. PCT/FR2017/050836, dated Jul. 6, 2017, 2 pages.

(Continued)

*Primary Examiner* — Ismael Izaguirre
(74) *Attorney, Agent, or Firm* — Moreno IP Law LLC

(57) ABSTRACT

The invention relates to a sole plate of a steam iron comprising a cover and a heating subassembly, in which the surface of the cover intended for being in contact with a garment comprises a steaming area onto which the steam outlet holes open and a drying area separate from the steaming area, the steaming area being located, at least partially, in the front third of said surface, the drying area being devoid of steam outlet holes and comprising a portion projecting outwards at the center of said surface.

15 Claims, 7 Drawing Sheets

(56) References Cited

U.S. PATENT DOCUMENTS

| | | | | |
|---|---|---|---|---|
| 5,619,813 | A * | 4/1997 | Forest | D06F 75/38 29/904 |
| 7,389,597 | B1 * | 6/2008 | Chen | D06F 75/20 38/77.83 |
| 7,490,423 | B2 * | 2/2009 | Zhang | D06F 75/20 38/93 |
| 2006/0130374 | A1 | 6/2006 | Yagi | |

OTHER PUBLICATIONS

International Search Report for International Application No. PCT/FR2017/050836, dated Jun. 27, 2017, 2 pages.

* cited by examiner

STEAM IRON SOLE PLATE

CROSS-REFERENCE TO RELATED APPLICATION

The present patent application claims the priority benefit of French patent application FR16/53145 which is herein incorporated by reference.

FIELD

The present application relates to a steam iron sole-plate.

BACKGROUND

Since Antiquity, it is known that a piece of fabric can be smoothed out by combining heat with an action of mechanical traction on its fibers. Along time, smoothing tools have evolved to pass from heated stones or smooth pebbles, which used to be displaced on the garment, to dry irons.

Observation had enabled to note that fibers were much easier to smooth out or to shape if they were wet and also that the conservation of such states was linked to temperature and to the drying speed.

This started the reign of the use of damp cloth between the soleplate of the iron and the fabric, which provided a quality still considered to date as being the best possible.

With the outbreak of electric power, irons, dry irons, and then steam irons, which have enabled to suppress the use of damp cloths, have been created. Despite undeniable results in terms of time gain and of convenience, those remained inferior to what was obtained with the latter.

The soleplates of such irons were manufactured in cast aluminum and polished to obtain a surface state and a flatness compatible with the desired use. Their defect was a fast clogging due to the carbonization of fabric particles embedding into the microporosities created by the polishing.

To solve this problem, soleplates formed of a heating portion made of cast aluminum having a cover made of laminated aluminum added thereon, forming the object of patent FR2593837 describing a method of bonding between the two portions, were created. Since the new material used could withstand, with no alteration, higher temperatures than cast aluminum, this enabled to apply various coatings or surface treatments such as described in U.S. Pat. No. 4,822,686 describing the application of an enamel to improve the ease of maintenance and the iron sliding ability.

The distribution of the steam under the surface of the soleplate was improved by an increase in the number of outlet holes and/or by the arranging of shapes hollowed out under the soleplate. Water drop or tear shapes or channels of multiple shapes are non-exhaustively known.

Over time, it was observed that the steam cushion formed at the iron-to-fabric interface could not totally escape, especially under the central portion, which locally resulted in a non-negligible humidity in the ironed garment requiring waiting before the storage.

A plurality of solutions were provided. Patent DE452559, for example, relative to a soleplate comprising on its front side a steaming area and on its back side an area for drying by distribution of overheated air. However, since the speed of the passage on the areas to be dried is incompatible with an efficient drying, all the more as the temperature of this air is insufficient, such a solution has proven to be inefficient.

Document U.S. Pat. No. 5,532,455 discloses a steam iron soleplate comprising, on its front portion, lateral holes and central holes for letting out steam, supplied by two different chambers, which forms a first steaming area, followed by a first drying area with no steam outlet, running transversely from one edge to the other of the soleplate. Such an arrangement is repeated a second time by extending to the back of the soleplate. According to the assignee, such an alternation of steaming and drying areas enables to perform a double action assumed to provide a better smoothing out. In reality, the ratio between the steaming and drying surface areas is not sufficient to provide a total drying. In fact, an area which has remained impregnated with the first wetting is wet again and the steam concentrated under the center of the soleplate cannot totally escape. The permanence of the pleats is thus not ensured.

A fine analysis of the phenomenon showed that the steam was trapped under the central portion of the soleplate, the explanation being that if the quantity of steam emitted by the holes could, for half of it, escape in free air along the edges, the other half had no way out, would remain concentrated at the center by the shape given to the belt of holes at the periphery, or by the shapes of the distribution channels.

The only free portion being the back side of the sole, the soleplate surface had to be adapted to favor the steam flow to this area during the ironing action, whereby grooves having any shapes and configurations, favoring such an escape to the back and/or the sides, have appeared.

An improvement solution appeared with the creation of soleplates in two portions with a heating portion fitted with a cover. U.S. Pat. No. 6,189,245 describes a cover comprising different steaming and drying areas with approximately 30% assigned to the steaming; the rest, assigned to the drying, comprising a lining formed by a multitude of small pads between which the steam can escape in all directions. Such an arrangement, despite substantial results in terms of performance, only enables to partially achieve the desired result.

SUMMARY

An object of an embodiment is to overcome all or part of the disadvantages of the previously-described steam irons.

Another object of an embodiment is to improve the drying of the garment during the steam ironing operation, by favoring a fast and complete escape thereof to avoid the forming of residual humidity in fabrics after the ironing.

Thus, an embodiment provides a steam iron soleplate comprising a cover and a heating subassembly. The surface of the cover intended to be in contact with a garment comprises a steaming area having the steam outlet holes emerging onto it and a drying area different from the steaming area, the steaming area being at least partly located on the front third of said surface, the drying area comprising no steam outlet holes and comprising a first step corresponding to a portion raised toward the outside at the central portion of said surface.

According to an embodiment, the steaming area is located on the front half, preferably on the front third, of said surface.

According to an embodiment, the first planar surface totally surrounds the raised portion.

According to an embodiment, the volume of the raised portion is inscribed between a first planar surface, coplanar with the steaming area, and a second planar surface located in a plane which is parallel to the first surface, the first and second surfaces being separated by a height in the range from 0.3 mm to 2 mm.

According to an embodiment, the raised portion is delimited on its sides by a third surface linking the first surface to the second surface.

According to an embodiment, the soleplate comprises, on the circumference of the cover, fourth surfaces recessed with respect to the first surface, substantially parallel to one another and contiguous to the circumference of the cover, and forming second steps.

According to an embodiment, the cover comprises lateral cover edges coupled to a cover heel and the junction between the second surface and the third surface is defined by a first line defined by:

on each side of the cover, first and second curve portions, each first and second curve portion being substantially parallel to the adjacent lateral cover edge and at a distance in the range from 25 mm to 45 mm from said lateral cover edge;

at the back of the cover, a first straight line portion parallel to the cover heel and at a distance in the range from 25 mm to 40 mm from the cover heel; and at the front of the cover, a first circular portion tangent to the first and second curve portions having a radius in the range from 5 mm to 15 mm.

According to an embodiment, the junction between the first surface and the third surface is defined by a second line defined by a constant distance from the first line in the range from 10 mm to 25 mm, the second line comprising:

a third curve portion parallel to the first curve portion;

a fourth curve portion parallel to the second curve portion;

a second circular portion parallel to the first circular portion;

a second straight line portion parallel to the first straight line portion;

a third circular portion having its center located at the crossing point of the first curve portion with the second straight line portion; and a fourth circular portion having its center located at the crossing point of the second curve portion with the first straight line portion.

According to an embodiment, temperature sensors are installed within hollow rivets provided in the cover or in ports provided in the subassembly.

According to an embodiment, the soleplate comprises fifth surfaces recessed with respect to the first surface, substantially parallel to one another and to the circumference of the cover and forming third steps, having a width in the range from 8 mm to 14 mm, and located at a distance in the range from 12 mm to 24 mm from the edge of the cover.

According to an embodiment, the steam outlet holes emerge onto one of the fifth surfaces.

According to an embodiment, the second steps each have a width in the range from 0.7 mm to 1.5 mm and a height in the range from 0.15 mm to 0.4 mm and the second steps form leading edges.

According to an embodiment, the shape of the leading edges comprises a radius in the range from 0.2 mm to 0.3 mm.

Another embodiment provides a method of manufacturing an iron soleplate such as previously defined, the assembly between its cover and its subassembly being performed:

for the front portion of the cover provided with steam outlet holes, by crimping of rivets extruded from the holes;

for the rear portion of the cover comprising no steam outlet holes, by using hollow rivets created by extrusion from the material of the cover and by crimping performed by local crushing of the ends of the hollow rivets, the generated deformation, by compressing the material pushed back into a chamfer, ensuring the locking between the cover and the subassembly.

According to an embodiment, the method comprises locally forming, in the rear portion of the cover assigned to the drying, notches having a width in the range from 2 mm to 4 mm to form chips each having a thickness greater than a half-thickness of the cover sheet which, folded down on the edge of the subassembly, ensure the locking between the cover and the subassembly.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

Figures 1, 2:
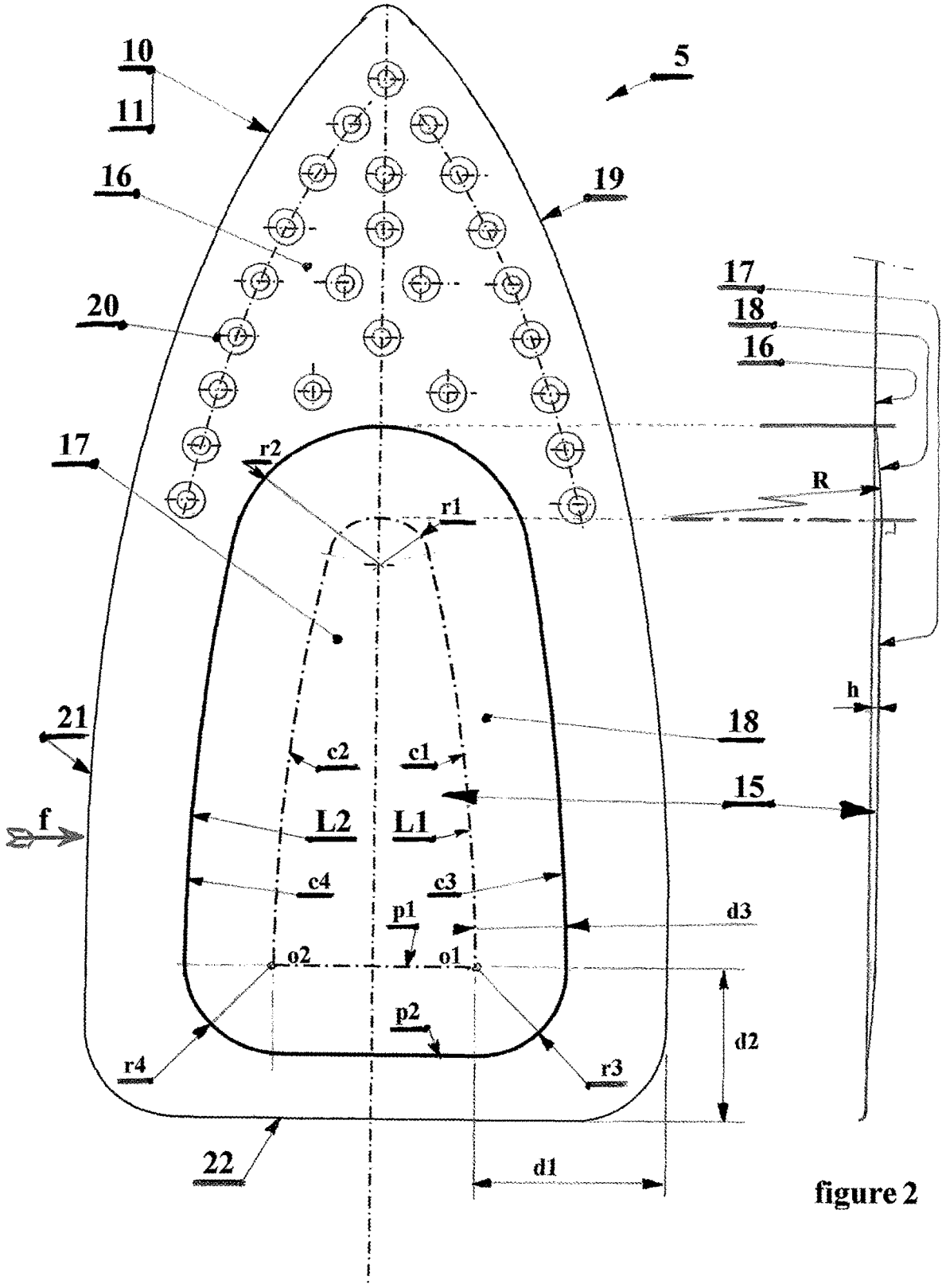
FIGS. 1 and 2 are a bottom view and a partial side view along direction f of an embodiment of an iron soleplate.

The same elements have been designated with the same reference numerals in the different drawings. For clarity, only those elements which are useful to the understanding of the described embodiments have been shown and are detailed. In particular, the inner components of a steam iron are well known by those skilled in the art and will not be described in detail.

In the following description, when reference is made to terms qualifying absolute positions, such as terms “front”, “rear”, “top”, “bottom”, “left”, “right”, etc., or relative positions, such as terms “above”, “under”, “upper”, “lower”, etc., or to terms qualifying directions, such as terms “horizontal”, “vertical”, etc., it is referred to the orientation of the drawings or to an iron in a normal position of use. The terms "approximately", "substantially", and "in the order of" are used herein to designate a tolerance of plus or minus 10%, preferably of plus or minus 5%, of the value in question.

According to an embodiment, the steam iron soleplate comprises at least one step intended to create a surface parallel to a base surface used as a base of contact of the iron on the garment.

According to an embodiment, the surface created by the step is raised with respect to the base surface. The raised surface is preferably located in the central portion of the drying area of the iron. The raised surface comprises no steaming holes and permanently bears on the garment at the same time as the base surface. The raised surface is coupled to the base surface by an intermediate surface surrounding the raised surface and joining the base surface. The intermediate surface may be planar or bulged to enable, on displacements of the iron on the garment and whatever the directions of the displacements, to chase the residual steam present in the garment towards the outside.

According to an embodiment, the surface created by the step is recessed with respect to the base surface. This enables to create, on the circumferences of the recessed surface, leading edges improving the quality and the rapidity of the ironing.

FIGS. 1 and 2 show a bottom view and a partial side view of a soleplate 5 of an iron. Soleplate 5 comprises two components: the first component is the cover and the second component is the heating subassembly, the cover covering the heating subassembly. In the following description, two embodiments will be described. In an embodiment, soleplate 5 comprises a thick cover which is designated with reference numeral 10. Cover 10 may be an aluminum cover having a thickness for example in the range from 1.5 mm to 2.5 mm. According to another embodiment, the soleplate comprises a thin cover which is designated with reference numeral 11. Cover 11 may be a cover made of a sheet of stainless steel or of another material having a thickness for example in the range from 0.2 mm to 0.6 mm. The heating subassembly, not shown in FIGS. 1 and 2, is specific to each type of cover and is designated with reference numeral 12 for the embodiment corresponding to cover 10 and with reference numeral 13 for the embodiment corresponding to cover 11. FIGS. 1 and 2 are identical for covers 10 and 11.

The modifications made to covers 10 to 11 with respect to conventional covers can be distributed as follows:

on the one hand, modifications which concern the surface of covers 10 or 11 in contact with the garment which may be identical in all points whatever the material of the cover; and on the other hand, modifications which are in relation with the fastening of the covers on their respective heating subassembly, specific to each cover type, according to their material.

In FIGS. 1 and 2, which show the outer portion of cover 10 or 11 in contact with the garment and which are common to the two types of covers 10 and 11, a step corresponding to a convex shape forming a relief 15, also called bulged portion or raised portion, defined with respect to a substantially planar reference surface 16, corresponding to the largest planar portion of cover 10 or 11 in permanent contact with the garment, can be distinguished. According to an embodiment, steaming holes 20 emerge into approximately the front half, preferably the front third, of surface 16 intended for the steaming.

The volume of raised portion 15 is defined by a substantially planar surface 17 aligned with the cover. Surface 17 is raised with respect to surface 16 and is located in a plane parallel thereto. A height h in the range from 0.3 to 2 mm separates the two surfaces 16 and 17. Surface 17 occupies a portion of the total surface area of cover 10 or 11 in contact with the garment which is in the range from 10% to 40%.

A line L1, shown in stripe-dot lines in FIG. 1, shows the limits of surface 17. Line L1 is defined by:

on each side, portions of curves c1 and c2 substantially parallel to their respective cover edge 19 for c1 and 21 for c2 and at a distance d1 which may be in the range from 25 mm to 45 mm, for example, equal to approximately 35 mm;

in the back, a straight line portion p1 parallel to cover heel 22 at a distance d2 which may be in the range from 25 mm to 40 mm, for example, equal to approximately 30 mm; and at the front, a circular portion r1 tangent to curves c1 and c2 having a radius which may be in the range from 5 mm to 15 mm, for example, equal to approximately 8 mm.

The volume of raised portion 15 is further defined by a surface 18 of connection between surface 16 and surface 17.

A full line L2 shows the limits of surface 18. Line L2 is defined by a constant distance d3 between lines L1 and L2, which may be in the range from 10 mm to 25 mm, for example, equal to approximately 17 mm. This is reflected on line L2 by a curve portion c3 parallel to curve portion c1, a curve portion c4 parallel to curve portion c2, a circular portion r2 parallel to circular portion r1, a straight line portion p2 parallel to straight line portion p1, and by two new circular portions: a circular portion r3 having a center of located at the crossing portion of curve portion c1 with straight line portion p1, and a circular portion r4 having a center o2 located at the crossing point of curve portion c2 with straight line portion p2.

Surface 18 of junction between the two lines L1 and L2 may be generated by the displacement of a straight line segment between the two lines, but it is preferentially defined by the circulation of a radius R having a center located on a line perpendicular to surface 17 vertically in line with line L1, defined as being the location of tangency points between radius R and surface 17. Line L2 is defined as the location of the points of intersection between radius R and surface 16.

Figure 3:
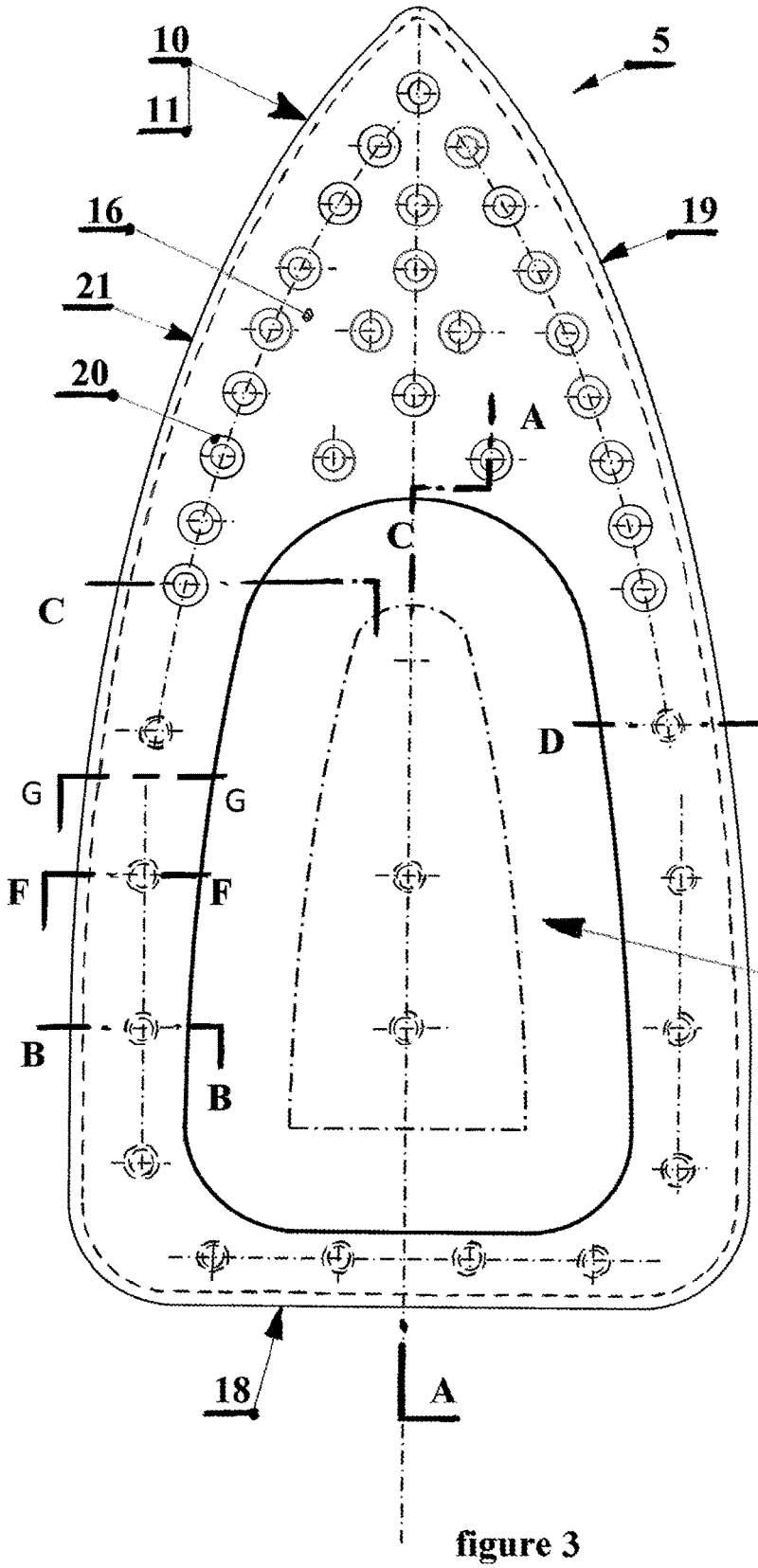
FIG. 3 is a view similar to FIG. 1 where hidden elements are shown in dotted lines.
Figure 5:
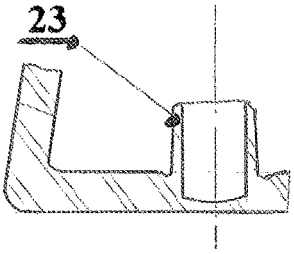
FIGS. 4, 5, 6, and 7 are cross-section views of FIG. 3 respectively along lines A-A, B-B, C-C, and D-D in the case where the soleplate comprises a thick cover
Figure 4:
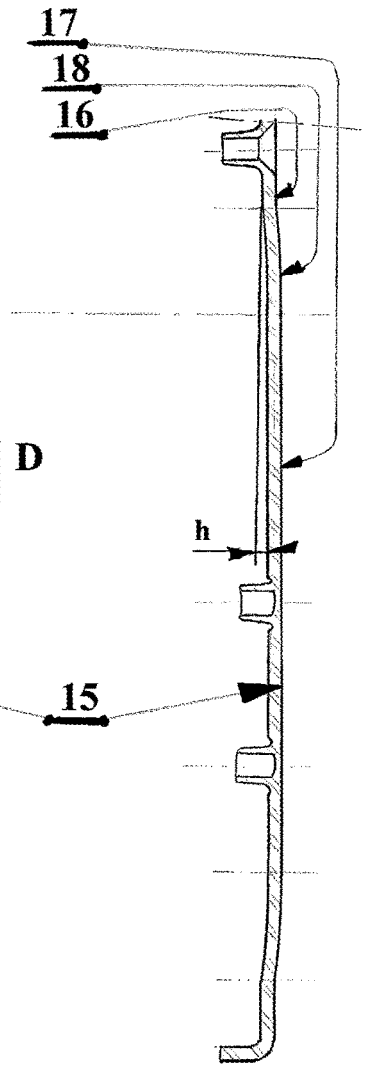

FIG. 3 is a view similar to FIG. 1 of cover 10 or 11 and FIGS. 4 and 5 are cross-section views of FIG. 3 respectively along lines A-A and B-B in the case of a thick cover 10. FIG. 3 shows hidden elements specific to cover 10 and shown in FIGS. 4 and 5.

In the drawings, one can distinguish, apart from the modifications common with cover 11, the following specific modifications of cover 10:

tubular shapes which are intended, among others, to be used as hollow rivets 23 to ensure the connection between the rear portion of cover 10, assigned to the drying, and heating subassembly 12. Their number, their distribution, and their usage mode are determined according to the selected usage. Tubular shapes 23 are positioned outside of the surface occupied by the steaming chamber.

Figure 6:
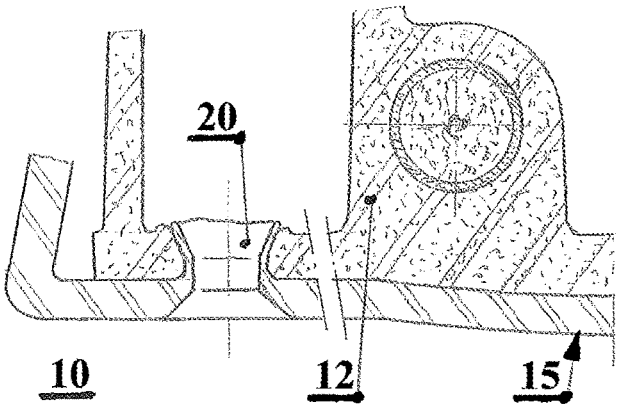
Figure 7:
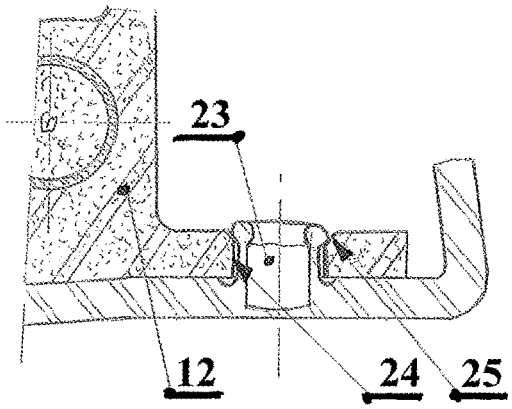
Figure 8:
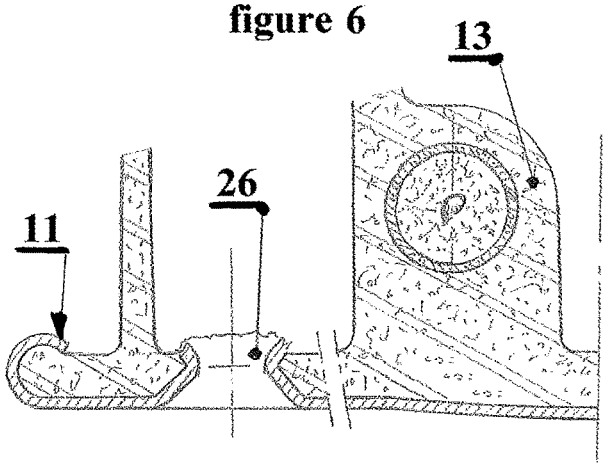
FIGS. 8 and 9 are cross-section views of FIG. 3 respectively along lines C-C and D-D in the case where the soleplate comprises a thin cover.
Figure 9:
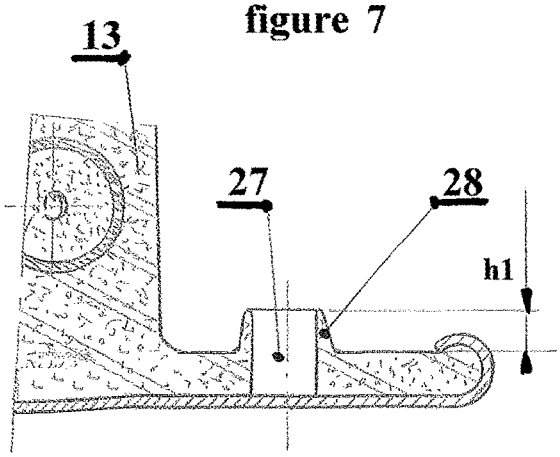

FIGS. 6 and 7 are cross-section views of FIG. 3 respectively along lines C-C and D-D in the case where the soleplate comprises cover 10 and FIGS. 8 and 9 are cross-section views of FIG. 3 respectively along lines C-C and D-D in the case where the soleplate comprises cover 11.

As appears in the drawings, heating subassemblies 12 and 13, made of cast aluminum overmolding a tubular heating element and comprising the steaming chamber, are modified with respect to conventional heating subassemblies as follows:

for their common portion ensuring the contact with the inner portion of covers 10 and 11: their cast surface, initially planar, is modified (FIG. 6) to repeat raised portion 15 which is positioned with, as a reference, the steaming holes present on each cast portion and each cover;

for the rear portion, reserved for the drying, specific to aluminum cover 10, holes 24 are provided, in front of each hollow rivet 23 (FIG. 7), in addition to those intended for the rivets resulting from the manufacturing of steaming holes 20, and a chamfer 25 is created at the inlet of each hole 24;

for the rear portion, intended for the drying, specific to cover 11 made of a steel sheet or of another material, the type of shape conventionally given to the edges of subassembly 13 along its contour are kept (FIG. 8) to allow a crimping.

Figure 10:
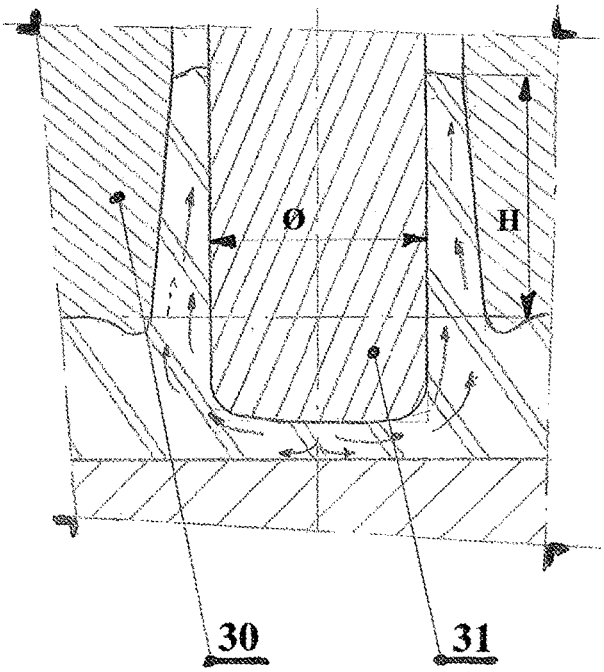
FIG. 10 shows an embodiment of a method enabling to obtain the structure shown in FIG. 7.

FIG. 10 illustrates an embodiment of a method enabling to obtain the structure shown in FIG. 7. In this embodiment, hollow rivets 23 are obtained by extrusion, the ductility of the aluminum of the cover enabling to apply this method by which a mobile punch under high pressure 30 blocks the material while the thrusting of cylindrical punch 31 makes it flow to form a rivet shaft having the desired height. As an example, to form hollow rivets 23 having an inner diameter Ø equal to 3 nm from a 2-mm thickness of material and the penetration of punch 31 being 1.5 mm, a shaft having a height H of approximately 4.5 mm can be obtained.

According to an embodiment, cover 10 and subassembly 12 may be assembled as follows:

for the front portion, the tubes extruded from steam outlet holes 20 are used, the crimping being performed, for example, according to the known techniques described in patent FR2593837;

for the back portion, hollow rivets 23 are used by proceeding by limited crushing of their end (visible in FIG. 7), the deformation generated by pushing back the material into chamfer 25 provided for this purpose ensures the locking between the two portions.

According to an embodiment, cover 11 and subassembly 13 may be assembled by keeping conventional methods, by the use of steaming holes 20 and the crimping of cover 11 on the circumference of subassembly 13.

Before positioning the parts against each other, the precaution of coating all the surfaces intended to be in contact with thermally-conductive grease which will prevent the forming of an insulating air blade therebetween is taken.

Figure 11:
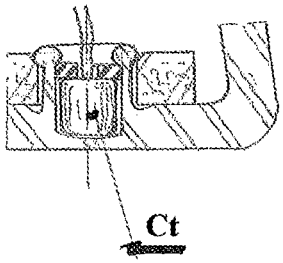
FIGS. 11 and 12 are cross-section views of FIG. 3 along line F-F according to other embodiments of the soleplate.

FIG. 11 is a cross-section view of FIG. 3 along line F-F of another embodiment where temperature sensors Ct are installed on cover 10 inside of certain hollow rivets 23 selected as being representative of the cover temperature.

As shown in FIG. 9, ports 27 may be provided in heating subassembly 13 to allow an access to cover 11, each of ports 27 is topped with a hollow cast cone 28, having a thickness for example in the range from 1 mm to 2 mm, protruding by a height h1 for example between 2 mm and 6 mm on the inner side of subassembly 13.

Figure 12:
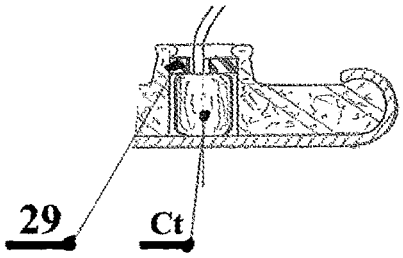

FIG. 12 is a cross-section view of FIG. 3 along line F-F of another embodiment where temperature sensors Ct are installed in ports 27, formed at points representative of the soleplate temperature to allow an access to cover 11.

The maintaining in place of the sensors will be ensured by the deformation, either of the head of rivets 23 as shown in FIG. 10 for cover 10, or of the top of hollow cone 28 as shown in FIG. 11 for cover 11 and by the arranging of a resilient pad 29 ensuring the sensor immobilization.

The collected information transmitted to a calculator and translated may enable to display, for example, on a liquid display screen visible by a user, the nature of the fabric that may be ironed.

Figure 13:
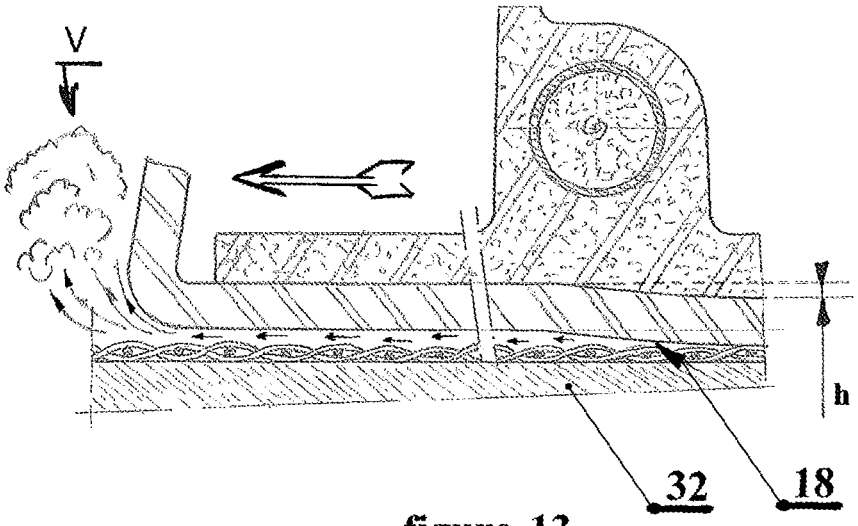
FIG. 13 is a cross-section view of FIG. 3 along line G-G illustrating the operation of the iron.

FIG. 13 is a cross-section view of FIG. 3 along line G-G illustrating the operation of the iron. During the ironing, at the level of surface 17 of raised portion 15, the bearing pressure is concentrated since the contact surface with garment 32 is decreased. The residual moisture, imprisoned in garment 32 under this surface, submitted to heat and to an enhanced pressure, has the possibility of laterally escaping, first in the space of height h formed between surfaces 16 and 17, and then towards the outside, as illustrated by arrow V in FIG. 13, under the effect of the displacement of surface 18 which creates a corner shape open towards the lateral edges of the soleplate. Apart from a general drying of the garment of better quality, the possibility of obtaining marked and persisting pleats is real.

The outer surface of each of the covers remains compatible with the application of known coatings, but its heat conductivity can be improved by a flash projection of boron nitride, for example, at the surface of the glaze slip before the cooking thereof.

It is further desirable to obtain the disappearing of the folds of the garment during the ironing thereof.

For this purpose, much research has been carried out, to result in solutions, all directed towards the improving of the iron/garment surface relations: better resistance to wearing, better sliding ability, better residual moisture discharge, or also better heat transmission.

Since the ironing efficiency can be defined as the best tradeoff between the following factors: speed/quality/decreased painfulness/decreased wearing of the garment, it was remarkable to observe that most of these actions had the sole purpose of optimizing the created relations.

This was neglecting the importance of the first action to which the fibers of a fabric are submitted during the ironing, which is a mechanical action of tensioning the fabric via the edge of the soleplate, which phenomenon can be observed, since any displacement of the iron generates the occurrence of a mobile ripple, parallel to this edge. With soleplates having added covers, such a traction on the fibers is decreased due, on the one hand, to the radius of curvature of their edge due to their manufacturing, and on the other hand to the decrease of their coefficient of friction on the garment. The improvements provided in these fields have actually adversely affected the rapidity of the shaping of the fibers since, for equivalent wetting conditions, obtaining straight fibers by stretching the fabric is more efficient and faster than doing it by pressing thereon to rectify them. There thus here is a possibility of improving the ironing speed.

An object of an embodiment is to substantially increase the ironing efficiency by improving the fiber tension from as soon as the first movement of the soleplate on the garment.

Figure 14:
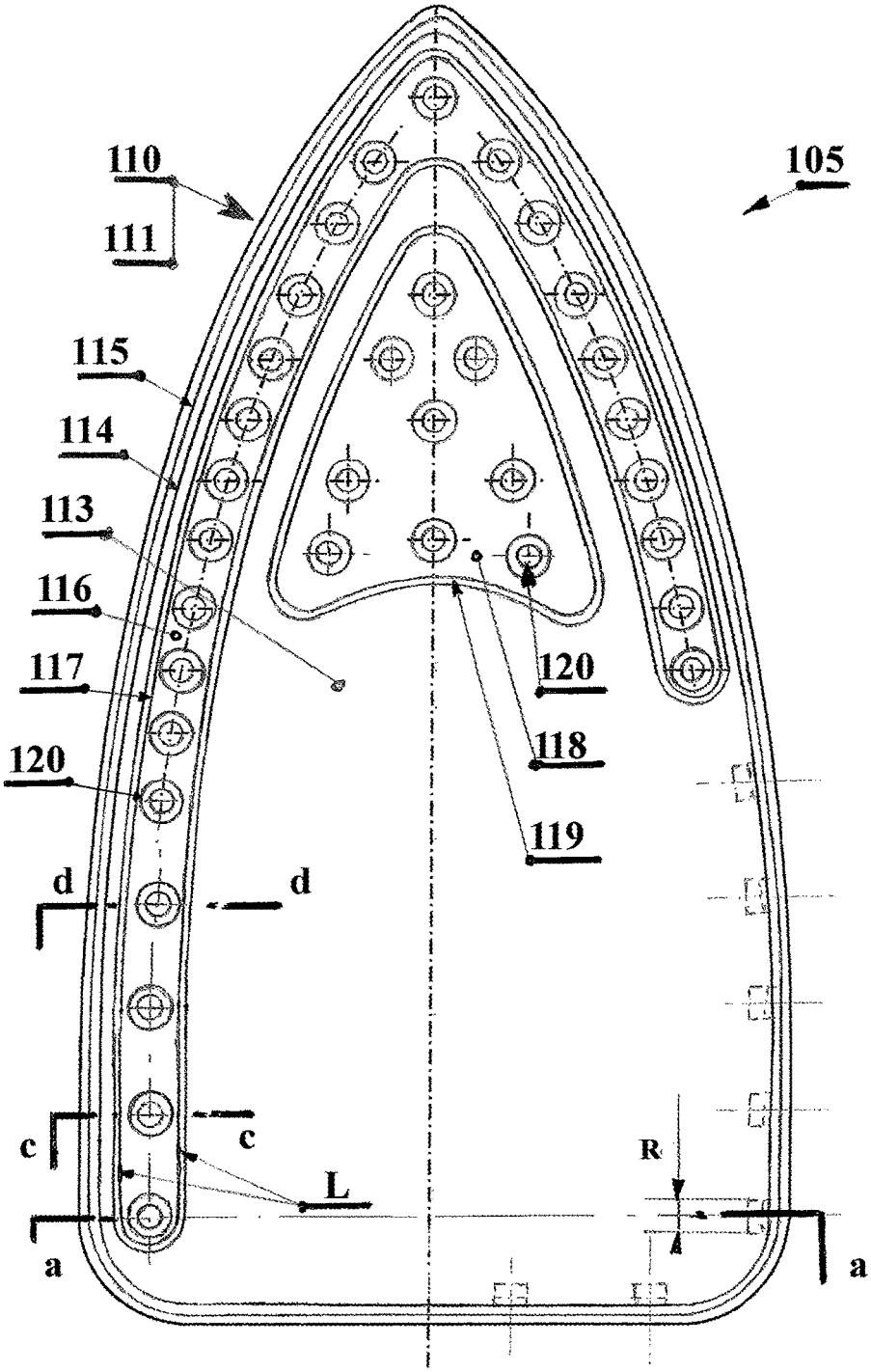
FIG. 14 is a bottom view of another embodiment of an iron soleplate.

FIG. 14 is a bottom view of a soleplate 105 of an iron. As previously described, soleplate 105 comprises two components: the first component is the cover and the second component is the heating subassembly, the cover covering the heating subassembly. In the following description, two embodiments will be described. In an embodiment, soleplate 105 comprises a thick cover which is designated with reference numeral 110. Cover 110 may be an aluminum cover having a thickness for example in the range from 1.5 mm to 2.5 mm. According to another embodiment, the soleplate comprises a thin cover which is designated with reference numeral 111. Cover 111 may be a cover made of a sheet of stainless steel or of another material having a thickness for example in the range from 0.2 mm to 0.6 mm. The heating subassembly, not shown in FIG. 14, is specific to each type of cover and is designated with reference 112 for the embodiment corresponding to cover 110 and by reference 113 for the embodiment corresponding to cover 111. FIG. 14 is the same for covers 110 and 111.

Figure 15:
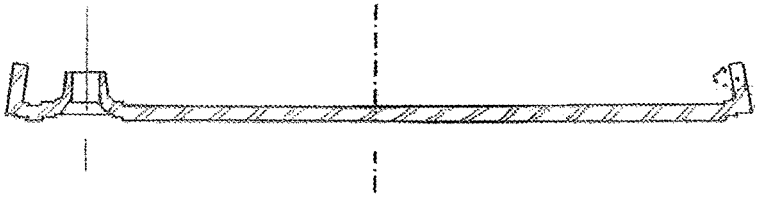
FIG. 15 is a cross-section view of the cover of the soleplate shown in FIG. 14 along line a-a.
Figure 16:
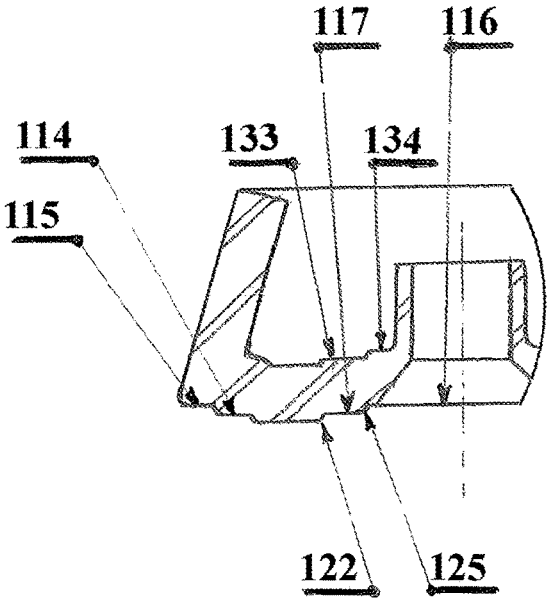
FIG. 16 is an enlarged view of a portion of FIG. 15.
Figure 17:
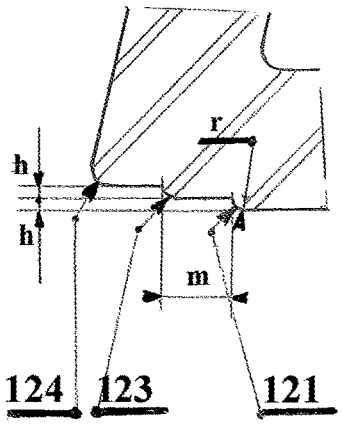
FIG. 17 is an enlarged view of a portion of FIG. 16.

FIG. 15 is a cross-section view of cover 110 or 111 along line a-a. FIG. 16 is an enlarged view of a portion of FIG. 15 in the case of a thick cover 110 and FIG. 17 is an enlarged view of a portion of FIG. 16 in the case of a thick cover 110.

As appears in FIGS. 14 to 16, cover 110 made of aluminum and cover 111 made of a steel sheet or of other materials forming the object of the invention comprise:

a reference surface 113, for example, substantially planar, corresponding to the portion of the cover in permanent contact with the garment;

a surface 114 and a surface 115, for example, substantially planar, substantially parallel to each other and to the edge of the cover, having widths m in the range from 0.7 mm to 1.5 mm, surfaces 114 and 115 surrounding cover 110 or 111;

a surface 116, for example, substantially planar, having its limits L substantially parallel to each other and to the edge of the cover. The axis of symmetry of surface 116, having a width for example in the range from 7 mm to 16 mm, is located at a distance for example in the range from 12 mm to 24 mm from the edge of the cover. Steaming holes 120 emerge onto surface 116 and delimit its length, which will be adapted according to their number; and a surface 117, for example, substantially planar, substantially parallel to limits L of surface 116 having a width for example in the range from 0.7 mm to 1.5 mm.

FIG. 14 shows two possible arrangements of surface 116. In the right-hand portion of FIG. 14, a surface 116 which extends from the front of the cover to the cover heel has been shown while in the left-hand portion of FIG. 14, surface 116 extends from the front of the cover to half of the cover. Preferably, surface 16 is distributed in the same way along two lateral edges of the cover.

Surfaces 114, 115, 116, and 117 show the basic modifications of cover 110 and 111, but other surfaces having different shapes but similar characterizations, such as for example surfaces 118 and 119, may be added according to needs.

Surfaces 114 to 119 are recessed with respect to reference surface 113. They are obtained by creating steps (particularly visible in FIG. 17) having a height h in the range from 0.15 mm to 0.4 mm. Each step height h generates a leading edge 121 and 122 for those in contact with reference surface 113, a leading edge 123 for that in contact with surface 114, a leading edge 124 for that at the crossing of the cover edge and of surface 115, as well as a leading edge 125 for that in contact with surface 117. Accordingly, surfaces 114 and 117 are on a same plane, as well as surfaces 115 and 116.

According to an embodiment, to avoid a garment wearing effect, each leading edge has a same radius r, for example, in the range from 0.2 mm to 0.3 mm, which is for example formed by die stamping and/or semishear to guarantee its dimensional regularity and a clean and flash-less surface condition.

For the manufacturing of covers 110 and 111, the quality and the dimensional guarantees of the leading edges are obtained by implementing different methods according to the cover material.

Figure 18:
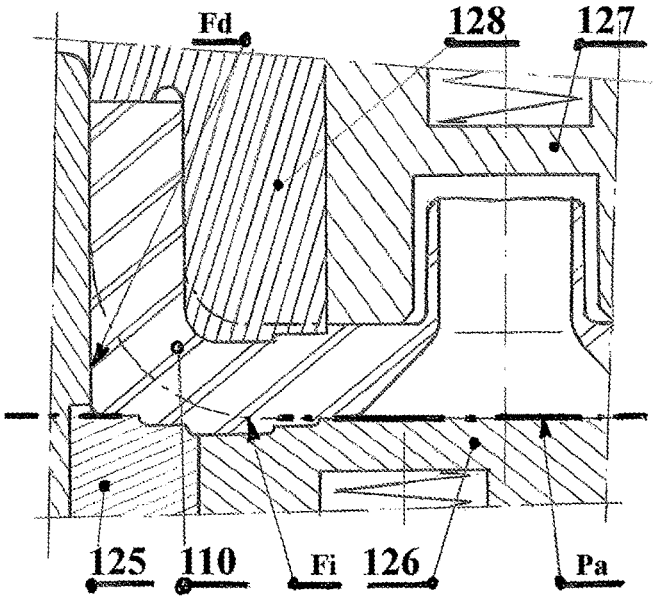
FIGS. 18, 19 illustrate embodiments of a method of manufacturing the cover of the soleplate shown in FIG. 14.

FIG. 18 illustrates an embodiment of a method of manufacturing cover 110. To form surfaces 114, 115, 116, and 117 as well as, if need be, surfaces 118 and 119, a die stamping is performed, by using the ductility of aluminum to displace matter from its initial shape, indicated by dotted line Fi, towards its final shape Fd. The cover is introduced into the tool after the operation of embossing and raising of the edges, and then positioned on landing plane Pa of matrixes 125 and 126 comprising, the recessed shapes of leading edges 121, 122, 123, 124, and 125 of radius r. The cover is maintained pressed against plane Pa by a pressure plate 127. A punch 128 having a shape and a penetration depth which have been designed to displace the quantity of aluminum just necessary for all the empty spaces to be filled is then introduced.

Figure 19:
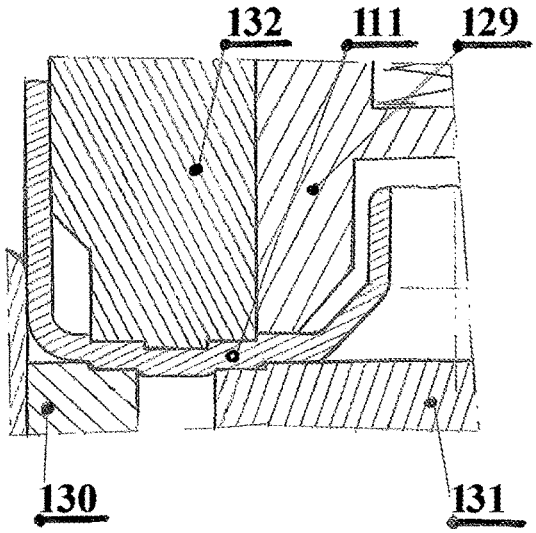

FIG. 19 illustrates an embodiment of a method of manufacturing cover 111. A semishear is carried out. Once the cover is positioned and held in place by a pressure plate 129 on matrixes 130 and 131, cutting punch 132 is taken down towards these matrices, into which it penetrates by height h.

Figure 20:
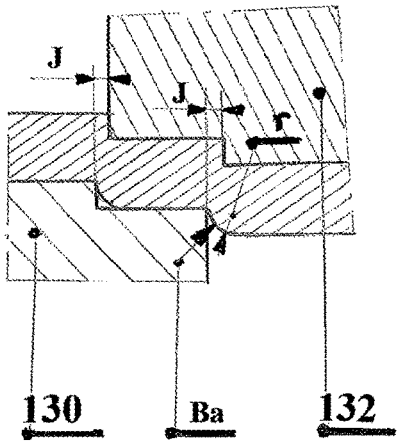
FIG. 20 is a detail view of FIG. 19.

FIG. 20 is a detail view of FIG. 19. Radius r of leading edges ba is obtained by varying clearance j between cutting punch 132 and matrices 130 and 131. Clearance j enables to set the radius after cutting, to obtain the desired radius r.

According to an embodiment, heating subassembly 112, formed of cast aluminum overmolding a tubular heating element and comprising the steaming chamber, is modified in the following manner, which is valid for aluminum covers 110 as well as for covers 111 made of steel or another material.

The manufacturing of the recessed portions of surfaces 116 and 117 complementarily generates, in relief with respect to the inner surface of the cover, protrusions 133 and 134, as shown in FIG. 16. The casting of subassembly 112 will be accordingly modified to house protrusions 133 and 134 at closest.

An embodiment of a method of assembling covers 110 or 111 and heating subassembly 112 will now be described.

Figure 21:
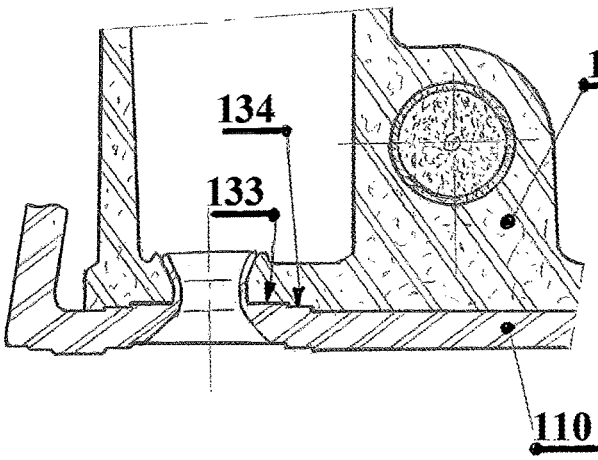
FIG. 21 is a cross-section view of the soleplate shown in FIG. 14 along line d-d.

FIG. 21 is a cross-section view of the soleplate shown in FIG. 14 along line d-d. For covers 110 and if the option of creating steam holes all the way to the back of the soleplate has been chosen as shown in FIG. 14 for the left-hand portion of soleplate 105, the technique of crimping by means of the steam holes described in patent FR2593837 is used.

Figure 22:
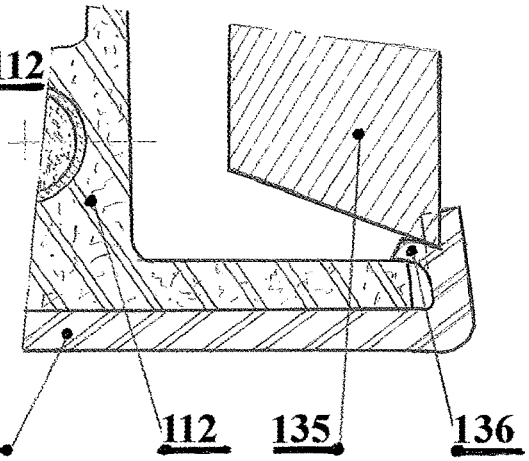
FIG. 22 illustrates an embodiment of a method of assembly between the cover and the heating subassembly of the soleplate shown in FIG. 14.

FIG. 22 illustrates an embodiment of a method of assembling cover 110 and heating subassembly 112.

If the selected option is that of a soleplate with separate steaming and drying areas, particularly such as described according to U.S. Pat. No. 6,189,245, a crimping by means of the steam holes in the steaming area is carried out and, for the drying area in the back portion as shown in FIG. 14 for the right-hand portion of soleplate 105, deprived of fastening means, notches of width R, for example, in the range from 2 mm to 4 mm, are locally created by sinking a blade 135, of corresponding width, to form a chip 136 having a thickness greater than a half thickness of the cover sheet, which, by being folded down on the edge of heating assembly 112, will locally ensure the locking between the two portions. There will be as many crimping points, according to this method, as necessary to provide a perfect contact between the inner surface of cover 110 or 111 and that of heating subassembly 112.

For covers 111, whatever the selected option, current known fastening methods are kept.

Before positioning the parts against each other, all the surfaces intended to be in contact will be coated with thermally-conductive grease which will prevent the forming of an insulating air film therebetween.

Figure 23:
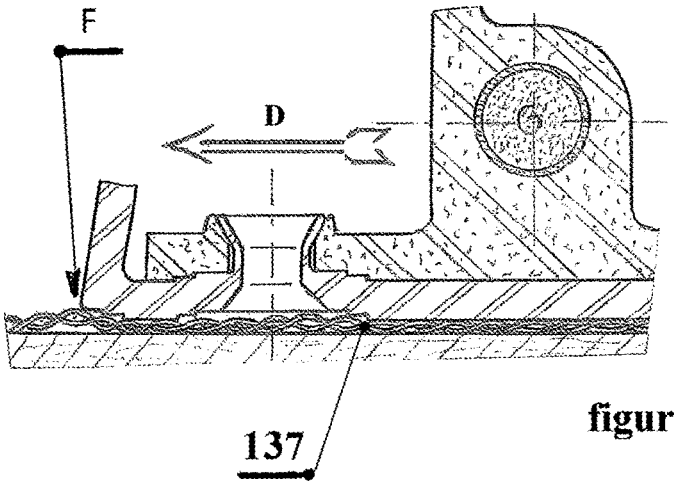
FIG. 23 is a cross-section view of FIG. 14 along line c-c illustrating the operation of the iron.

FIG. 23 is a cross-section view of FIG. 14 along line c-c illustrating the operation of the iron. During the ironing, at the level of fabric 137 to be ironed, the repeating of the traction (area T) exerted by the movement of the iron (arrow D) on the garment by the plurality of leading edges improves the rapidity of its flattening or of the forming of pleats.

Various embodiments with different variations have been described hereabove. It should be noted that those skilled in the art may combine these various embodiments and variations without showing any inventive step. As an example, surfaces 114 and 115 of soleplate 105 described in relation with FIGS. 14 to 23 may be implemented with the soleplate 5 described in relation with FIGS. 1 to 13.

The invention claimed is:

1. A steam iron soleplate comprising a cover and a heating subassembly, wherein the surface of the cover intended to be in contact with a garment comprises a steaming area having the steam outlet holes emerging onto it and a drying area different from the steaming area, the steaming area being located on the front half of said surface, the drying area comprising no steam outlet holes and comprising a first step corresponding to a portion raised toward the outside at the central portion of said surface, the volume of the raised portion being inscribed between a first planar surface, coplanar with the steaming area and a second planar surface located in a plane which is parallel to the first surface.

2. The steam iron soleplate of claim 1, wherein the steaming area is located on the front third of said surface.

3. The iron soleplate of claim 1, wherein the first planar surface totally surrounds the raised portion.

4. The steam iron soleplate of claim 1, wherein the first and second surfaces are separated by a height in the range from 0.3 mm to 2 mm.

5. The steam iron soleplate of claim 4, wherein the raised portion is delimited on its sides by a third surface linking the first surface to the second surface.

6. The steam iron soleplate of claim 5, comprising, on the circumference of the cover, fourth surfaces recessed with respect to the first surface, substantially parallel to each other and contiguous to the circumference of the cover, and forming second steps.

7. The iron soleplate of claim 5, wherein the cover comprises lateral cover edges coupled to a cover heel and wherein the junction between the second surface and the third surface is defined by a first line defined by:

on each side of the cover, first and second curve portions, each first and second curve portion being substantially parallel to the adjacent lateral cover edge and at a distance in the range from 25 mm to 45 mm from said lateral cover edge;

at the back of the cover, a first straight line portion parallel to the cover heel and at a distance in the range from 25 mm to 40 mm from the cover heel; and at the front of the cover, a first circular portion tangent to the first and second curve portions having a radius in the range from 5 mm to 15 mm.

8. The iron soleplate of claim 7, wherein the junction between the first surface and the third surface is defined by a second line defined by a constant distance with the first line in the range from 10 mm to 25 mm, the second line comprising:

a third curve portion parallel to the first curve portion;

a fourth curve portion parallel to the second curve portion;

a second circular portion parallel to the first circular portion;

a second straight line portion parallel to the first straight line portion;

a third circular portion having its center located at the crossing point of the first curve portion with the first straight line portion; and a fourth circular portion having its center located at the crossing point of the second curve portion with the first straight line portion.

9. The iron soleplate of claim 1, wherein temperature sensors are installed within hollow rivets provided in the cover or in ports provided in the subassembly.

10. The iron soleplate of claim 6, comprising fifth surfaces recessed with respect to the first surface, substantially parallel to one another and to the circumference of the cover and forming third steps, having a width in the range from 8 mm to 14 mm, and located at a distance in the range from 12 mm to 24 mm from the edge of the cover.

11. The iron soleplate of claim 10, wherein the steam outlet holes emerge onto one of the fifth surfaces.

12. The iron soleplate of any of claim 6, wherein the second steps each have a width in the range from 0.7 mm to 1.5 mm and a height in the range from 0.15 mm to 0.4 mm and wherein the second steps form leading edges.

13. The iron soleplate of claim 12, wherein the shape of the leading edges comprises a radius in the range from 0.2 mm to 0.3 mm.

14. A method of manufacturing the iron soleplate of claim 1, wherein the assembly between the cover and the subassembly is performed:

for the front portion of the cover provided with steam outlet holes, by crimping of rivets extruded from the holes;

for the rear portion of the cover comprising no steam outlet holes, by using hollow rivets created by extrusion from the material of the cover and by crimping ensured by local crushing of the ends of the hollow rivets, the generated deformation, by compressing the material pushed back into a chamfer, ensuring the locking between the cover and the subassembly.

15. The method of claim 14, comprising locally forming, in the rear portion of the cover assigned to drying, notches having a width in the range from 2 mm to 4 mm to form chips each having a thickness greater than a half-thickness of the cover sheet which, folded down on the edge of the subassembly, ensure the locking between the cover and the subassembly.

* * * * *